US006620081B2

(12) United States Patent
Phillips

(10) Patent No.: US 6,620,081 B2
(45) Date of Patent: Sep. 16, 2003

(54) EXERCISE STAND AND CENTRIFUGAL RESISTANCE UNIT FOR A BICYCLE

(76) Inventor: Cal M. Phillips, 4435 Jewell La., Platteville, WI (US) 53818

( * ) Notice: Subject to any disclaimer, the term of this patent is extended or adjusted under 35 U.S.C. 154(b) by 145 days.

(21) Appl. No.: 09/910,163

(22) Filed: Jul. 20, 2001

(65) Prior Publication Data

US 2003/0027692 A1 Feb. 6, 2003

(51) Int. Cl.[7] ..... A63B 69/16
(52) U.S. Cl. ..... 482/57; 482/61
(58) Field of Search ..... 482/57, 60, 61, 482/63, 110, 114–119; 188/78, 184, 185; 211/1, 17, 20–24

(56) References Cited

U.S. PATENT DOCUMENTS

| | | | | | |
|---|---|---|---|---|---|
| 4,262,899 | A | * | 4/1981 | Alvarez | 482/61 |
| 4,346,793 | A | * | 8/1982 | Fuse et al. | 188/134 |
| 4,524,851 | A | * | 6/1985 | Sawano et al. | 188/134 |
| 4,595,194 | A | * | 6/1986 | Previtali | 482/61 |
| 4,941,651 | A | | 7/1990 | Phillips | |
| 4,969,642 | A | | 11/1990 | Phillips | |
| 4,976,424 | A | * | 12/1990 | Sargeant et al. | 482/6 |
| 5,145,478 | A | | 9/1992 | Minoura | |
| 5,152,729 | A | | 10/1992 | Phillips | |
| 5,433,681 | A | | 7/1995 | Minoura | |
| 5,468,201 | A | | 11/1995 | Minoura | |
| 5,472,392 | A | | 12/1995 | Haan | |
| 5,522,781 | A | | 6/1996 | Minoura | |
| 5,611,759 | A | | 3/1997 | Zeh | |
| 5,916,068 | A | | 6/1999 | Chisholm | |
| 5,944,637 | A | | 8/1999 | Stickler | |
| 6,042,517 | A | | 3/2000 | Gunther | |

* cited by examiner

*Primary Examiner*—Nicholas D. Lucchesi
*Assistant Examiner*—Tam Nguyen
(74) *Attorney, Agent, or Firm*—John V. Stewart

(57) ABSTRACT

A first support arm 2 fixed to a base 1, a second support arm 3 pivotally attached to the base. A cam operated by a foot lever 6B controls the pivot position of the second arm, moving it toward or away from the first arm to clamp or release the rear axle of a bicycle between the arms. An inward-facing cup 2A, 3A on each arm holds the ends of the bicycle axle. The cups are vertically adjustable on the arms. Adjustments optimize the frame for any size bicycle wheel. A resistance unit 7 attached to the base has a tire contact roller 7E. A centrifugal clutch in the resistance unit urges a rotating friction plate against a stationary friction pad, providing ideal ride resistance ranging from zero at start-up to full hill-climbing resistance that supports a rider standing on the bicycle pedals at maximum output.

9 Claims, 8 Drawing Sheets

EXERCISE STAND AND CENTRIFUGAL RESISTANCE UNIT FOR A BICYCLE

BACKGROUND OF THE INVENTION

1. Field of the Invention

This invention relates to stands that hold a bicycle stationary for exercise and provide rolling resistance that simulates bicycle riding.

2. Description of Prior Art

Prior exercise stands for bicycles provide rolling resistance of various types, each of which has disadvantages. Frictional resistance units that are manually controlled do not provide resistance that increases realistically with speed. Thus, adjustment may be required at higher speeds, distracting the user. Air impellers are noisy and have no inherent momentum, so they require a separate heavy flywheel for realistic momentum. Air impellers do not provide high enough resistance for hill training, in which the rider stands on the pedals for maximum force. The advantage of air impellers is that they do not overheat. Fluid impellers are less noisy, but are expensive because they required a fluid-tight chamber with axle seals, fluid fill means, etc. Fluid impellers have a strong tendency to over-heat and leak fluid. Thus, they are not highly practical. They also have inadequate resistance for hill training. The impeller must turn extremely fast to be effective, so the tire-contact roller must have a small diameter. This tends to cause tire slippage, squealing, and wear. High impeller rpm requires dynamic balancing for vibration-free operation, which is prohibitively expensive. Fluid impeller units often generate vibration during use. They need a separate flywheel for momentum, which adds expense, but making the impeller heavy enough for a flywheel would be even more expensive. Magnetic resistance units use eddy currents in magnetic fields between moving and stationary permanent magnets. Magnetic units tend to have less resistance at higher speeds, which is the opposite of the desired resistance curve for realistic ride simulation.

Prior exercise stands for bicycles provide various means for mounting a bicycle on the stand. Commonly the rear axle is clamped between opposed cups on the stand. The opposed cups must be separated for insertion and removal of the bicycle rear axle, and moved toward each other to clamp the axle firmly between them. This has been previously done by mounting at least one of the cups on a threaded shaft that can be turned to move the cup toward or away from the opposite cup. However, it is very awkward to hold a bicycle in position with one hand while turning a knob near the rear axle. Another approach is providing a hand-lever that moves one cup toward or away from the opposite cup. This is faster, but still requires one hand on the lever, leaving only one hand to hold the bicycle in position. One series of prior bicycle stands (Minoura) offered foot operated clamping via rod linkages to a plunger the moves one of the cups. However, it was not successful in the market due to inadequate force transmission, and allowance of play. This type of linkage is also expensive to produce and is subject to damage.

Some prior exercise stands for bicycles do not provide full adjustability for different sized bicycles. Others provide adjustability, but hold the rear tire of smaller bicycles off the ground. Small bicycles mounted in these stands will not be level unless the front tire is also raised off the ground. Holding one or both of the tires off the ground makes the bicycle difficult to mount for the small rider, and gives an unnatural ride feeling.

U.S. Pat. No. 4,941,651 shows a manually controlled frictional resistance unit and a manual clamping lever U.S. Pat. No. 5,944,637 shows a fluid impeller resistance unit U.S. Pat. No. 6,042,517 shows a magnetic resistance unit U.S. Pat. No. 5,522,781 shows a stand design that holds smaller tires off the ground U.S. Pat. No. 5,145,478 shows a stand with foot pedal and rod linkage to the clamp Other examples of related prior art are listed on the front page of the patent. The present invention overcomes the above shortcomings of the prior art.

SUMMARY OF THE INVENTION

The objectives of the present invention are provision of an exercise stand for a bicycle with realistic ride resistance that increases with speed, provides little or no resistance during start-up, provides completely solid support of a bicycle without play, provides quick and easy mounting and removal of a bicycle from the stand, provides full adjustability of the stand for all sizes of bicycles, supports the rear tire of any size bicycle no more than ⅛ inch off the ground, provides maximum durability, minimum maintenance, minimum cost, minimum weight, and minimum folded size for shipping.

The objectives of the present invention are achieved with a first support arm 2 fixed to a base 1, a second support arm 3 pivotally attached to the base. A cam operated by a foot lever 6B controls the pivot position of the second arm, moving it toward or away from the first arm to clamp or release the rear axle of a bicycle between the arms. An inward-facing cup 2A, 3A on each arm holds the ends of the bicycle axle. The cups are vertically adjustable on the arms. Other adjustments optimize the frame for any size bicycle wheel. A resistance unit 7 attached to the base has a tire contact roller 7E driven by the rear tire of a bicycle. A centrifugal clutch in the resistance unit urges a rotating friction plate against a stationary friction pad, providing ideal ride resistance ranging from zero at start-up to full hill-climbing resistance that supports a rider standing on the bicycle pedals at maximum output.

| REFERENCE NUMBERS | |
|---|---|
| 1. | Base |
| 1A. | Base foot |
| 2. | Left support arm |
| 2A. | Left axle-holder cup |
| 2B. | Bicycle axle holder cup shaft |
| 2C. | Cup position selector washer |
| 2D. | Cup attachment lock nut |
| 2E. | Cup attachment main nut |
| 2F. | Scalloped slot for cup vertical adjustment |
| 2G. | Left support arm cap |
| 2H. | Enlargement or node in scalloped slot |
| 3. | Right support arm |
| 3A. | Right axle holder cup |
| 3G. | Right support arm cap |
| 4. | Left leg |
| 4H. | Leg extension indexing slot on first tube of left leg |
| 5. | Right leg |
| 5A. | First tube of leg |
| 5B. | Extension tube of leg |
| 5C. | Extension adjustment knob |
| 5D. | Threaded extension adjustment shaft |
| 5E. | Leg upper end cap |
| 5F. | Stop nut frozen on shaft |
| 5G. | Threaded extension adjustment block |
| 5H. | Leg extension indexing slot on first tube of right leg |
| 5J. | Leg extension indexing pin on extension tube |
| 5K. | Strut release pin hole |
| 5L. | Leg extension foot |
| 5M. | Leg to arm pivot attachment bolt |
| 6. | Pivot attachment of leg to base |
| 6A. | Cam |
| 6B. | Cam lever |
| 6C. | Cam support block |
| 6D. | Pivot bolt |
| 6E. | Pivot bolt nut |
| 7. | Resistance unit |
| 7A. | Resistance unit axle |
| 7B. | First bearing |
| 7C. | Second Bearing |
| 7D. | Third bearing |
| 7E. | Rotary force receiver roller |
| 7F. | First drive plate |
| 7G. | Second drive plate |
| 7H. | Centrifugal ball |
| 7J. | Friction pad |
| 7K. | Backing plate |
| 7L. | Second drive plate return spring |
| 7M. | Ball pocket on second drive plate |
| 7N. | Ball pocket on first drive plate |
| 7P. | Resistance unit axle mounting threads |
| 7Q. | Resistance unit pivotal mounting bar |
| 7R. | Resistance unit pivotal mounting bar bolt |
| 7S. | Resistance unit axle mounting bolt |
| 7T. | Resistance unit pivot adjuster |
| 8. | Folding leg strut |
| 8A. | Folding leg strut slot |
| 8B. | Folding leg strut release pin |
| 8C. | Folding leg strut leg-to-arm attachment bolt |

TERMINOLOGY

Left, right: With respect to a rider on a bicycle mounted in the stand.

DETAILED DESCRIPTION

Figure 1:
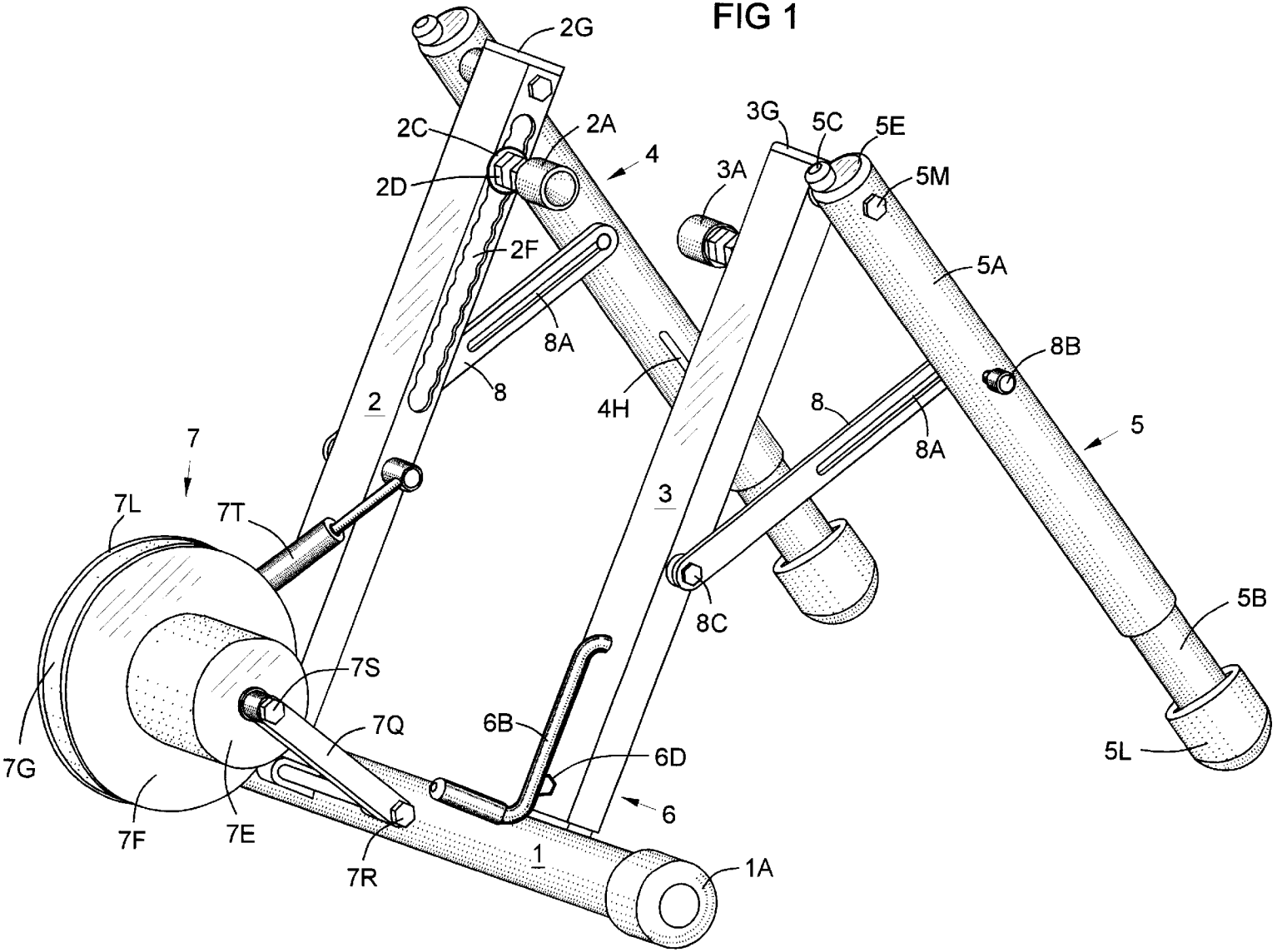
FIG. 1 is a perspective view of the trainer.
Figure 2:
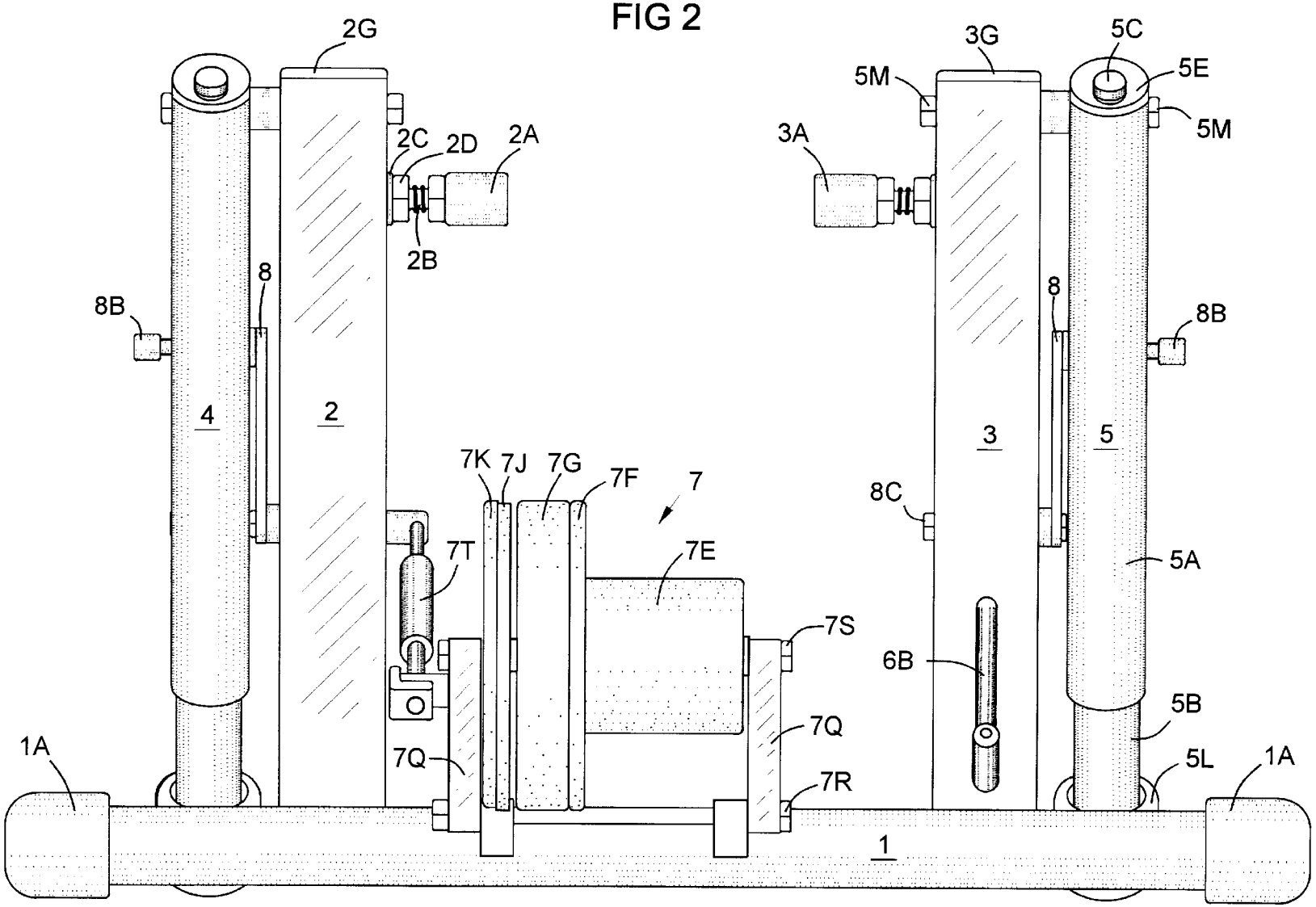
FIG. 2 is a back view of the trainer arms in the closed position.
Figure 3:
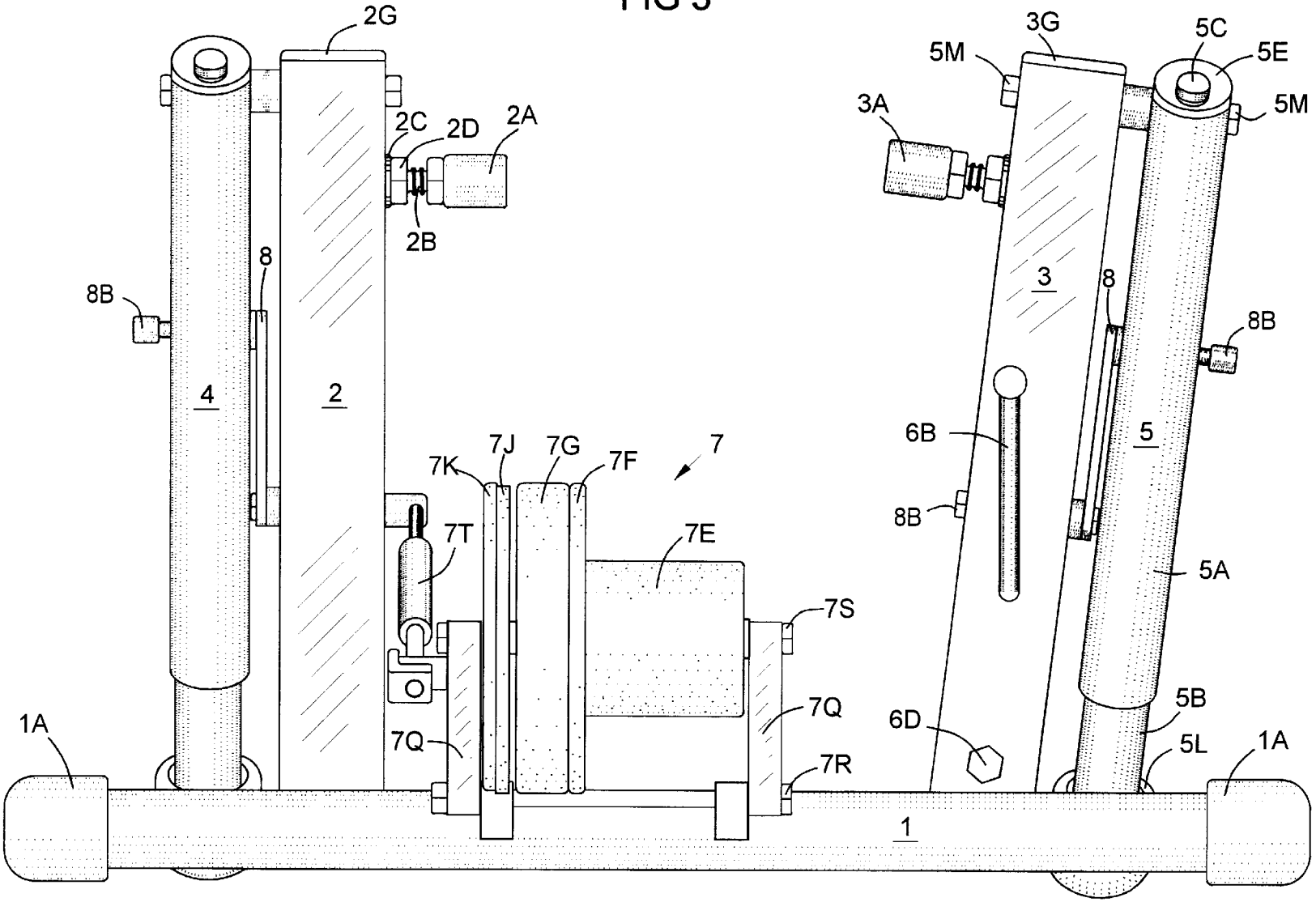
FIG. 3 is the view of FIG. 2 with the trainer arms in the open position.
Figure 4:
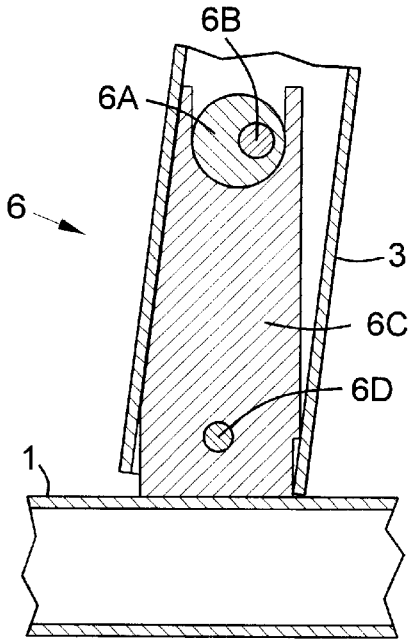
FIG. 4 is a back sectional view of the cam in open position.

FIG. 1 shows an overall perspective view of the present exercise stand for a bicycle. First and second support arms 2, 3 are attached to a base 1. The second arm 3 is pivotally attached to the base, and pivots toward or away from the first arm to clamp or release the ends of a rear bicycle axle between the arms. Opposed cups 2A, 3A on the arms receive the ends of the bicycle axle.

Figure 5:
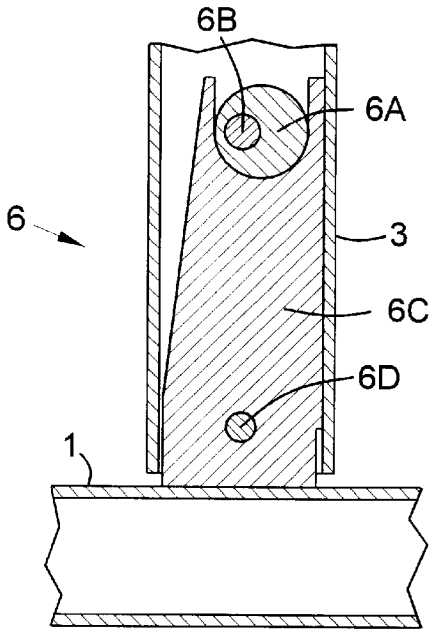
FIG. 5 is a back sectional view of the cam in closed position.
Figure 6:
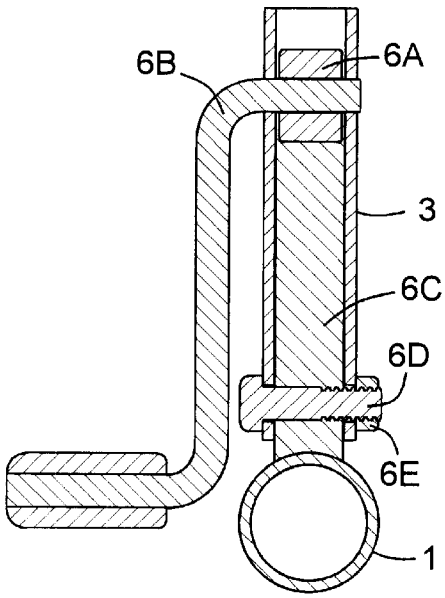
FIG. 6 is a right sectional view of the cam in closed position.
Figure 7:
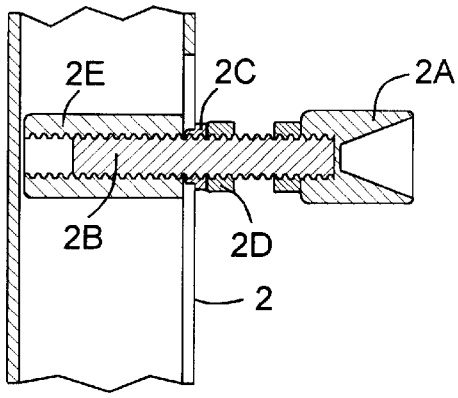
FIG. 7 is a back sectional view of the left axle holder cup.
Figure 8:
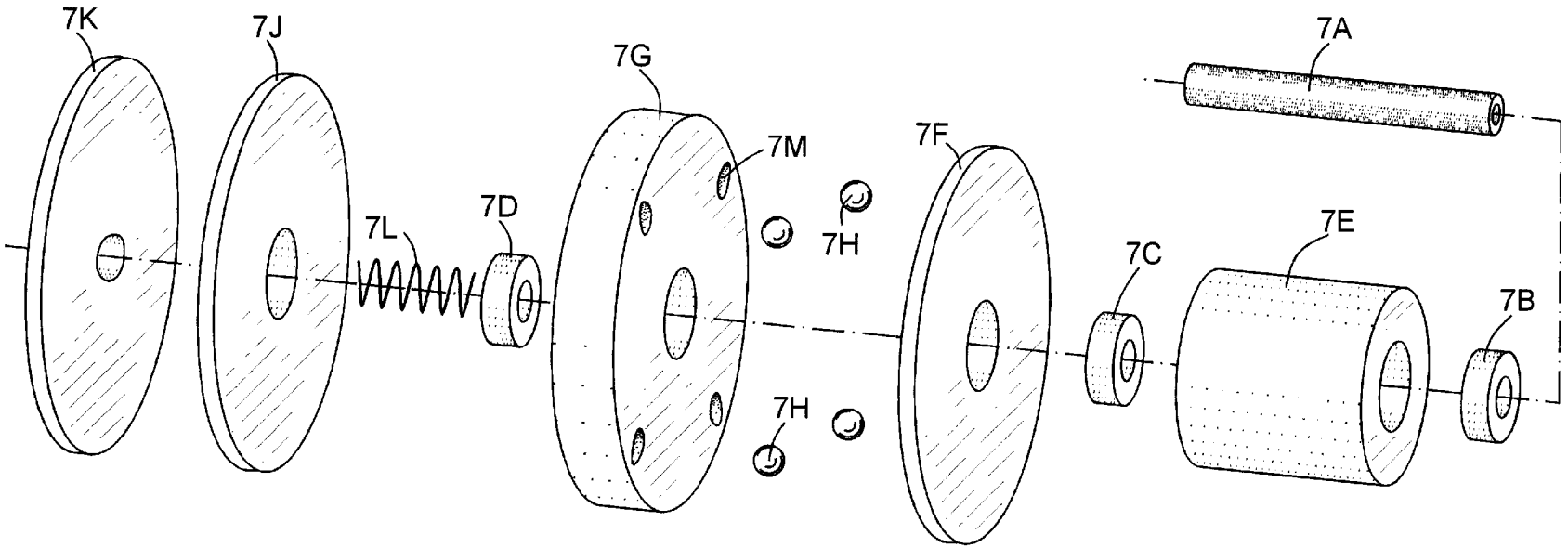
FIG. 8 is an exploded view of the resistance unit.

The pivot position of the second arm is controlled by a cam 6A operated by a foot lever 6B, as shown in FIGS. 1-6. A cam support block 6C is attached to the base. It supports the cam 6A, which in turn supports the arm 3. A user operates the cam lever 6B with a foot to open the arms as in FIG. 3 to admit a bicycle rear axle, then to close the arms as in FIG. 2 to clamp the bicycle axle between the opposed cups. As shown in FIG. 5 the cam forces the arm 3 against the support block, which stops the arm in a vertical position. This eliminates all play in the arm, providing completely solid support of a bicycle.

The separation distance of the opposed cups 2A, 3A in the closed position of the arms 2, 3 is adjustable within the range of bicycle rear axle lengths. This is done by using a wrench to release a lock nut 2D on the cup attachment threaded shaft 2B. The cup can now be turned, which turns the threaded attachment shaft 2B in the main nut 2E. The main nut is a nut that fits closely within the arm tube so that it cannot turn, although it can slide within the arm to allow vertical adjustment as next described. Preferably an appropriate wrench for the lock nut is provided removably attached to one of the arms.

The vertical position of the cups is adjustable by selection of attachment location along a scalloped slot 2F in each arm as shown in FIG. 1. The scalloping provides a series of substantially equal sized enlargements or nodes 2H in the slots that fix the cups at discrete levels. Each node has a corresponding node at the same level in the scalloped slot on the opposite arm. A cup positioning washer 2C on the cup attachment shaft has a portion that fits closely within a node. The cup lock nut 2D is loosened with the wrench to the extent that the cup positioning washer can be moved out of a given node of the slot. The cup assembly can then be moved along the slot to a different node. The left and right cups are at the same height when they are in the same node of the respective slots. This eliminates guesswork in matching the height of the two cups. 7B,7C on the axle, and is rotated by frictional contact with the rear tire of a bicycle. A first drive plate 7F is fixed to the roller portion about the resistance unit axle. A second drive plate 7G is mounted with a low-friction bearing 7D on the axle adjacent the first drive plate. A stationary backing plate 7K is fixed to the axle on the Opposite side of the second drive plate from the first drive plate. The backing plate supports a friction pad 7J adjacent the second drive plate.

Figure 9:
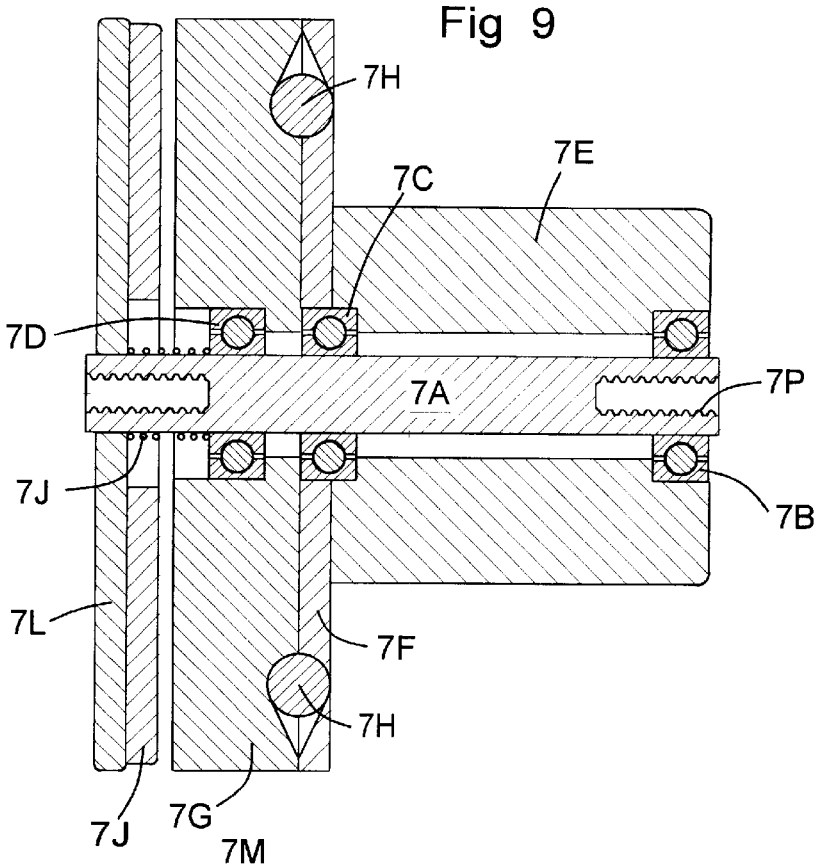
FIG. 9 is a back sectional view of the resistance unit at rest.
Figure 10:
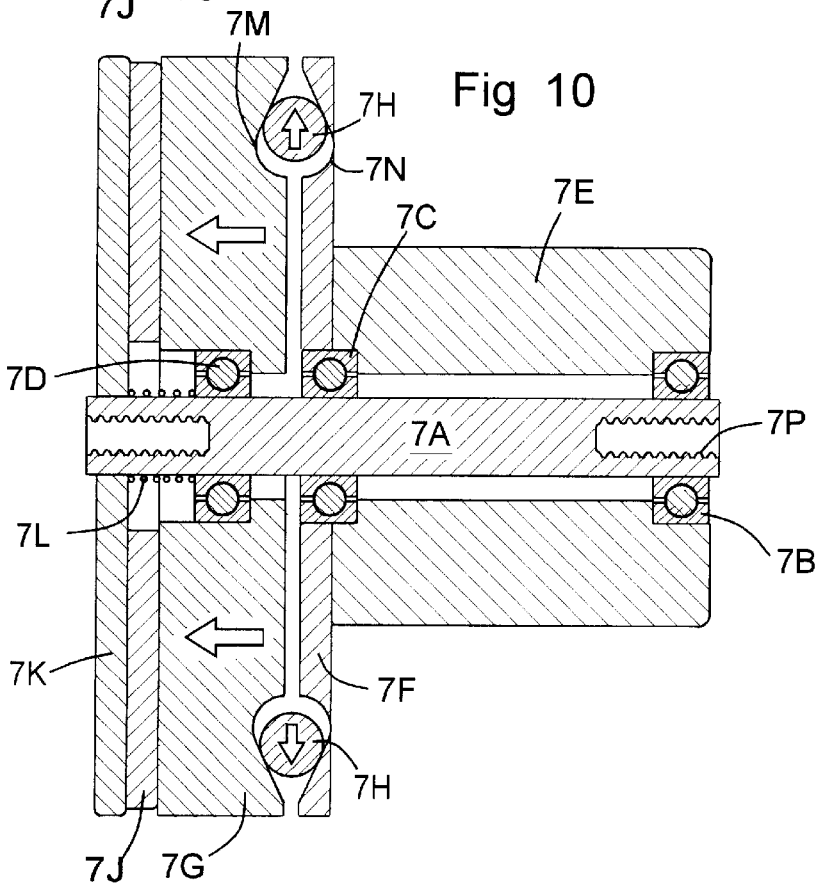
FIG. 10 is a back sectional view of the resistance unit at speed.
Figure 11:
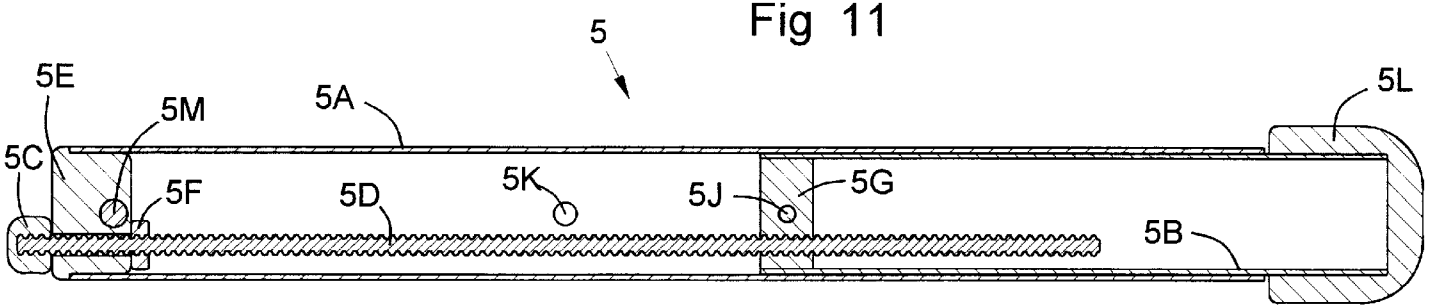
FIG. 11 is a right side sectional view of a telescoping leg retracted.
Figure 12:
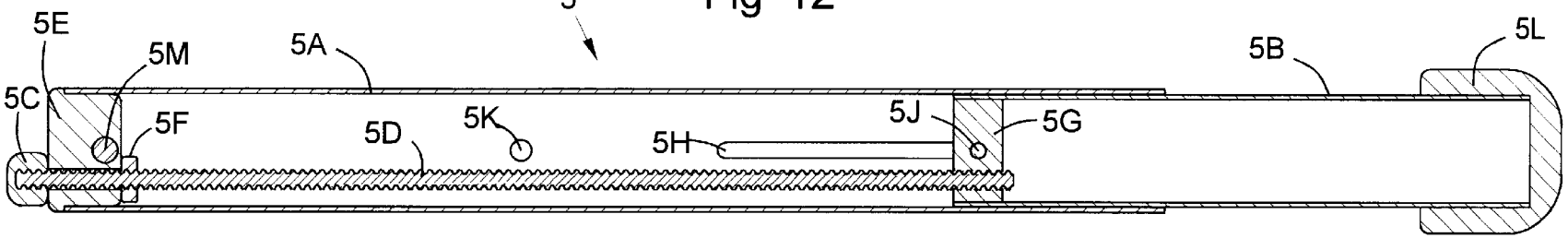
FIG. 12 is a right side sectional view of a telescoping leg extended.
Figure 14:
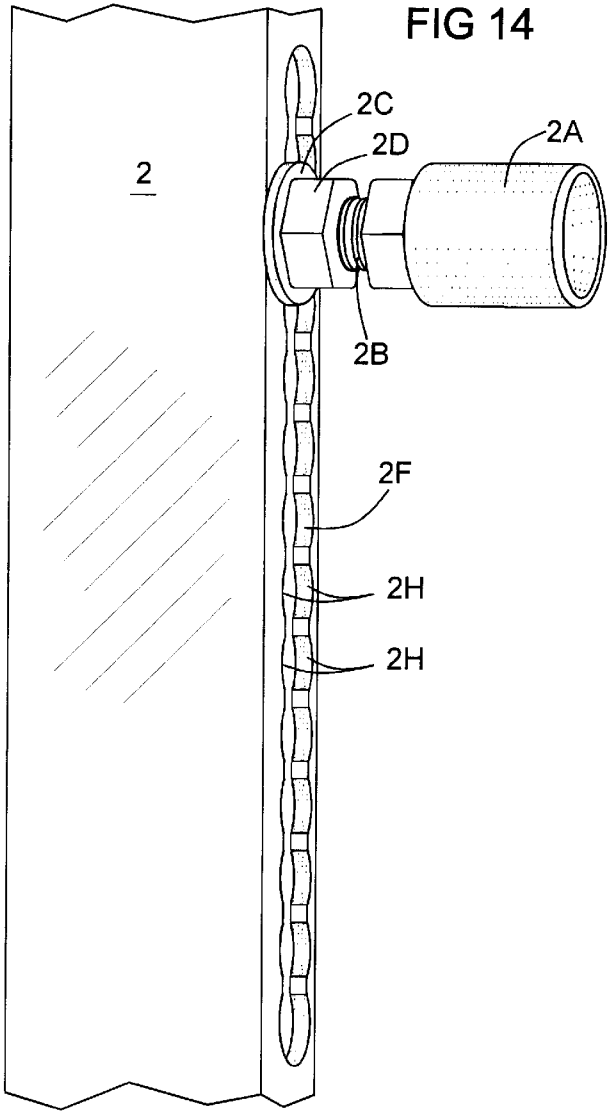
FIG. 14 is the view of FIG. 14 tightened at a selected height.
Figure 13:
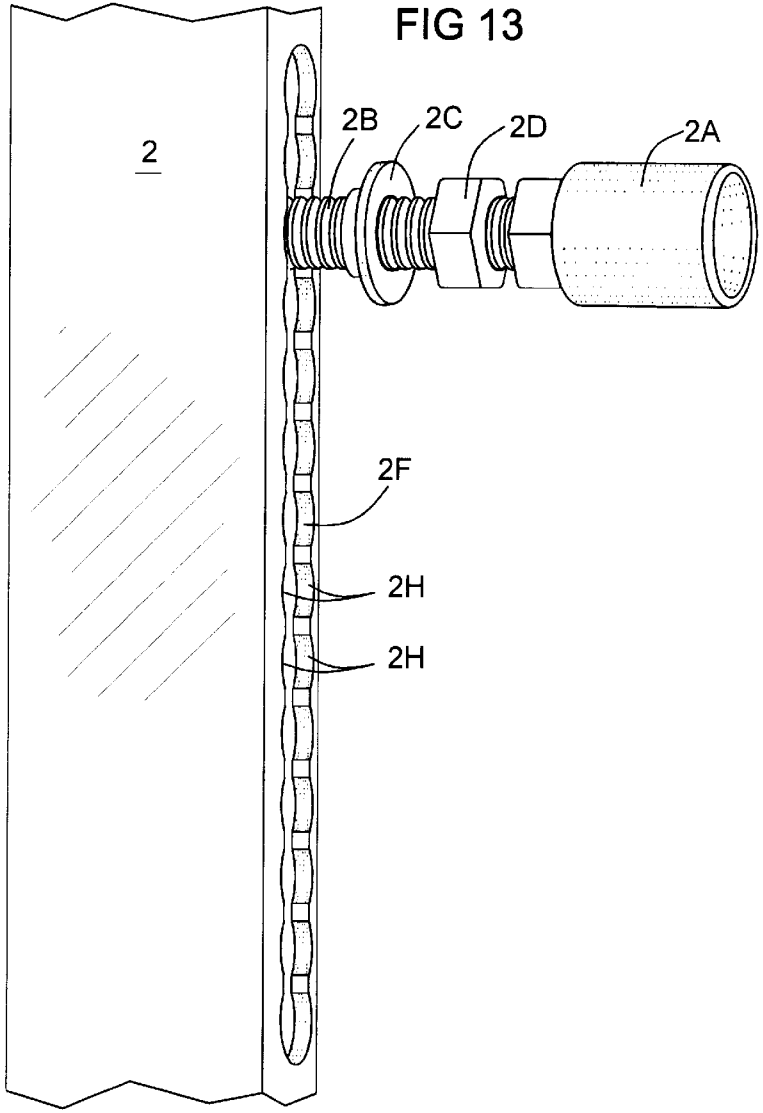
FIG. 13 is a perspective view of a cup attachment loosened for vertical adjustment.

As shown in FIGS. 9 and 10 the first and second drive plates are rotationally coupled by three or more balls 7H between them in opposed slots 7M, 7N in the facing surfaces of the two plates. Each of the opposed slots is elongated radially. The proximal end of each slot is deeper than the distal end. Thus, when the balls are urged outward by centrifugal force, they urge the drive plates apart as shown in FIG. 10. This pushes the second drive plate against the friction pad, resulting in a braking force on the rotating assembly, causing resistance on the bicycle tire in proportion to the rotation speed of the tire.

The resistance curve as a function of rotation speed is determined by several design elements, including the slope of depth of the ball slots, and the mass density of the balls. Steel balls are preferred, due to durability, high mass density, and low cost. The preferred resistance curve provides little or no resistance at low speeds. This allows a rider to start pedaling in a final gear without strain. The resistance curve should preferably increase starting at about 8–10 miles per hour, and should provide enough resistance at about 40 miles per hour for a rider to stand on the pedals for hill training.

This resistance unit overcomes the disadvantages of the existing types mentioned in the prior art section. It can be inexpensively produced, even by machining, because each part is a simple solid of rotation except for the ball slots, which are milled simply with a ball end mill. It does not need a separate flywheel, since it provides its own rotating mass. It allows the user to start in a high gear without strain to simplify use. It provides enough resistance for hill training. It is very durable and reliable. It does not need high rotation speed, so it has a large diameter force receiver roller. This eliminates tire slippage, squealing, and tire wear. The lower rotation speed and the lack of impeller-induced fluid turbulence reduce vibration and noise. It is very quiet. It rotates slowly enough to allow rotary sensing by current computerized ride information units and simulators. Other current resistance units must rotate too fast for the sensor response, so the sensors must be attached to the bicycle wheel.

Although the present invention has been described herein with respect to preferred embodiments, it will be understood that the foregoing description is intended to be illustrative, not restrictive. Modifications of the present invention will occur to those skilled in the art. All such modifications that fall within the scope of the appended claims are intended to be within the scope and spirit of the present invention.

I claim:

1. An exercise stand for a bicycle, comprising:

a base;

a first arm having lower and upper ends, the lower end of the first arm fixed to the base;

a second arm having lower and upper ends, the lower end of the second arm attached to the base by a pivot attachment that pivots the second arm toward and away from the first arm;

means for controlling the pivot position of the second arm with foot operation;

first and second opposed cups on the first and second arms respectively, the cups having open ends facing each other;

at least one of the cups being adjustable toward and away from the other cup; and a rotary resistance unit attached to the base between the two arms, having a tire contact roller and means for braking the roller increasingly with rotation speed;

whereby the pivot controlling means can be operated by a user's foot to move the second arm away from the first arm, a bicycle rear axle can then be positioned between the cups, and the pivot controlling means can then be operated to move the second arm toward the first arm and clamp the axle between the two cups.

2. The exercise stand of claim 1, wherein the pivot controlling means comprises:

a cam support block attached to the base:

a cam in the cam support block;

a lever having a shaft fixed to the cam; and the lever shaft passing through at least one part of the second arm.

3. The exercise stand of claim 1, wherein both cups have selectable attachment points on the arms, with means to maintain both cups on a horizontal line at each selected attachment point.

4. The exercise stand of claim 3, wherein the vertically adjustable attachment points comprise a sequence of enlargements or nodes along a scalloped slot in of the two arms, each node having a corresponding node at the same height in the other arm;

and each cup Is attached to a respective arm via a threaded shaft with a washer that has a portion fitting closely within one of the nodes.

5. The exercise stand of claim 1 wherein the rotary resistance unit comprises:

a resistance unit axle;

a rotary force receiver roller rotatably mounted on the resistance unit axle at a fixed axial position;

a first drive plate attached to the roller;

a second drive plate rotatably mounted on the resistance unit axle adjacent the first drive plate, the second drive plate axially slidable on the resistance unit axle;

the first and second drive plates having facing surfaces;

a backing plate fixed to the resistance unit axle on the opposite side of the second drive plate from the first drive plate, the backing plate having a friction surface facing the second drive plate; and a plurality of balls mounted between the first and second drive plates, each ball mounted in a pair of opposed pockets in the facing surfaces of the first and second drive plates, each of the opposed pockets being radially elongated having a proximal end and a distal end, the distal end of the pocket being shallower than the proximal end;

whereby radially outward movement of the balls by centrifugal force causes the balls to urge the first and second drive plates apart, pushing the second drive plate against the friction surface of the backing plate, braking the roller.

6. The exercise stand of claim 1 further comprising:

a first leg attached to the upper end of the first arm;

a second leg attached to the upper end of the second arm;

each leg comprising a first tube having upper and lower ends, the upper end of the first tube pivotally attached to the upper end of the respective arm; a releasable strut attached between the first tube and the respective arm, forming a rigid A-frame that can be released and folded for compact storage; a second tube having an upper end slidably mounted in the first tube, and a lower end extending from the lower end of the first tube; and means to extend the second tube adjustably from.

7. The exercise stand of claim 6 wherein the upper end of the first tube has a cap, and the means to extend comprises:

a threaded block in the upper end of the second tube;

a leg extension shaft threadedly engaged in the threaded block, the leg extension shaft having upper and lower ends;

a hole in the cap;

the upper end of the threaded leg extension shaft passing through the hole in the cap;

a manual twist knob on the upper end of the threaded leg extension shaft; and means to index or fix the second tube rotationally with respect to the first tube.

8. A rotary resistance unit for a bicycle-driven exercise machine, comprising an axle;

a rotary force receiver roller rotatably mounted on the axle at a fixed axial position;

a first drive plate attached to the roller;

a second drive plate rotatably mounted on the axle adjacent the first drive plate, the second drive plate axially slidable on the axle;

the first and second drive plates having facing surfaces;

a backing plate fixed to the axle on the opposite side of the second drive plate from the first drive plate, the backing plate having a friction surface facing the second drive plate; and a plurality of balls mounted between the first and second drive plates, each ball mounted in a pair of opposed pockets in the facing surfaces of the first and second drive plates, each of the opposed pockets being radially elongated having a proximal end and a distal end, the distal end of the pocket being shallower than the proximal end;

whereby radially outward movement of the balls by centrifugal force causes the balls to urge the first and second drive plates apart, pushing the second drive plate against the friction surface of the backing plate.

9. An exercise stand for a bicycle, comprising:

a base;

two arms, each arm having a lower end attached to the base and an upper end;

a cup on each of the arms, the two cups having open ends facing each other;

at least one of the cups being movable toward and away from the other of the two cups;

both cups having vertically selectable attachment points on the arms comprising a sequence of enlargements or nodes along a scalloped slot in each arm, each node having a corresponding node at the same height in the other arm, each cup being attached to a respective one of the two arms via a threaded shaft with a washer that has at least a portion fitting closely within a selected one of the nodes.

* * * * *